US009271526B2

(12) United States Patent
Liu

(10) Patent No.: US 9,271,526 B2
(45) Date of Patent: Mar. 1, 2016

(54) ELECTRONIC CIGARETTE BOX

(71) Applicant: Qiuming Liu, Shenzhen (CN)

(72) Inventor: Qiuming Liu, Shenzhen (CN)

(73) Assignee: HUIZHOU KIMREE TECHNOLOGY CO., LTD., SHENZHEN BRANCH, Shenzhen, Guangdong Province (CN)

( * ) Notice: Subject to any disclaimer, the term of this patent is extended or adjusted under 35 U.S.C. 154(b) by 0 days.

(21) Appl. No.: 14/446,297

(22) Filed: Jul. 29, 2014

(65) Prior Publication Data

US 2014/0353185 A1 Dec. 4, 2014

Related U.S. Application Data

(63) Continuation-in-part of application No. PCT/CN2013/076312, filed on May 28, 2013.

(51) Int. Cl.
*A24F 15/12* (2006.01)
*A24F 47/00* (2006.01)

(52) U.S. Cl.
CPC ..... *A24F 15/12* (2013.01); *A24F 47/008* (2013.01)

(58) Field of Classification Search
CPC ..... A24F 15/12; A24F 15/14; A24F 15/16; A24F 47/008; B65D 85/1009; B65D 85/1027
USPC ..... 206/249, 250, 252–255; 221/224–231, 221/247–250
See application file for complete search history.

(56) References Cited

U.S. PATENT DOCUMENTS

| | | | | | |
|---|---|---|---|---|---|
| 1,648,074 | A | * | 11/1927 | Sticht | 221/227 |
| 1,897,702 | A | * | 2/1933 | Lewnes | 206/255 |
| 1,963,971 | A | * | 6/1934 | Coon | 221/249 |
| 2,071,167 | A | * | 2/1937 | Kellett | 221/260 |
| 2,303,859 | A | * | 12/1942 | Panzer | 206/250 |
| 2,618,379 | A | * | 11/1952 | Hardy | 221/250 |
| 2,812,057 | A | * | 11/1957 | Brownfield | 206/250 |
| 2,970,721 | A | * | 2/1961 | Fontana | 221/227 |
| 3,164,295 | A | * | 1/1965 | Shwarz | 221/232 |
| 3,861,523 | A | * | 1/1975 | Fountain et al. | 206/255 |
| 4,798,310 | A | * | 1/1989 | Kasai et al. | 206/252 |
| 5,086,918 | A | | 2/1992 | D'Antonio | |
| 8,794,434 | B2 | * | 8/2014 | Scatterday et al. | 206/256 |
| 2013/0248385 | A1 | * | 9/2013 | Scatterday et al. | 206/249 |

FOREIGN PATENT DOCUMENTS

| | | | | |
|---|---|---|---|---|
| CN | 1171216 | A | | 1/1998 |
| CN | 2293955 | Y | | 10/1998 |
| CN | 2659161 | Y | | 12/2004 |
| CN | 2839165 | Y | | 11/2006 |
| DE | 2406038 | A1 | * | 8/1975 |
| GB | 2369108 | A | * | 5/2002 |
| WO | 2013/076312 | | | 5/2013 |

* cited by examiner

*Primary Examiner* — Bryon Gehman
(74) *Attorney, Agent, or Firm* — Cheng-Ju Chiang

(57) ABSTRACT

The present invention provides an electronic cigarette box including a box body. The box body dispose cigarette slot for accommodating an electronic cigarette and an ejecting device to eject the electronic cigarette. The ejecting device includes an ejecting mechanism and a lever mechanism. The ejecting device is disposed at a lower end of the cigarette slot along an in-and-out direction of the electronic cigarette and resists between the electronic cigarette and the box body. The lever mechanism and the ejecting mechanism are correspondingly and engagingly disposed. The electronic cigarette is capable of being inserted into the cigarette slot for storage or ejected out from the cigarette slot for use repeatedly.

17 Claims, 10 Drawing Sheets

ELECTRONIC CIGARETTE BOX

The application is a U.S. continuation-in-part application under 35 U.S.C. §111(a) claiming priority under 35 U.S.C. §120 and §365(c) to International Application No. PCT/CN2013/076312 filed May 28, 2013, the contents of which are incorporated by reference herein in their entirety for all intended purposes.

FIELD OF THE INVENTION

The present invention relates to electronic cigarettes, especially relates to an electronic cigarette box.

BACKGROUND OF THE INVENTION

Generally, the existing electronic cigarette box is composed of two components, a box body and a cover body. Inside the box body disposes a cigarette slot, and electronic cigarettes are placed in the cigarette slot. When users need to smoke, open the cover body firstly, then take out electronic cigarette. Because a nozzle of the electronic cigarette is usually located at an opening of the cigarette slot, users need to directly clamp the nozzle by finger to take out electronic cigarette, causing the nozzle pollution and unsanitary use. In addition, since the arrangement space between the electronic cigarettes is very small, it makes the electronic cigarette not easy to be removed, and the extraction of the electronic cigarette is not convenient.

SUMMARY OF THE INVENTION

A technical problem of the present invention to be solved is to provide an electronic cigarette box, in which an electronic cigarettes arranged can automatically ejected out, and which ensures the effective use sanitation of electronic cigarettes, and convenient storage and extraction.

To achieve the above-mentioned object, the present invention provides an electronic cigarette box including a box body. The box body dispose cigarette slot for accommodating an electronic cigarette and an ejecting device to eject the electronic cigarette. The ejecting device includes an ejecting mechanism and a lever mechanism. The ejecting device is disposed at a lower end of the cigarette slot along an in-and-out direction of the electronic cigarette and resists between the electronic cigarette and the box body. The lever mechanism and the ejecting mechanism are correspondingly and engagingly disposed. The electronic cigarette is capable of being inserted into the cigarette slot for storage or ejected out from the cigarette slot for use repeatedly.

Preferably, the lever mechanism is detachably latches the ejecting mechanism, when the electronic cigarette is inserted into the cigarette slot for storage, the lever mechanism latches the ejecting mechanism; and when the electronic cigarette is ejected out from the cigarette slot, the lever mechanism release the latching on the ejecting mechanism.

Preferably, the ejecting device further includes an ejecting button, and the ejecting button controls the rotation of the lever mechanism.

Preferably, the ejecting mechanism includes a bottom seat and a first elastic element orderly disposed below the cigarette slot, the lever mechanism is a rod body fixed in the box body by a rotation shaft, one end of the lever mechanism includes a latch, and the other end of the lever mechanism includes a driving portion.

Preferably, the ejecting button and the lever mechanism are disposed as separate structure, one end of the ejecting button abuts to the driving portion of the lever mechanism and the other end of the ejecting button passes through a side wall of the box body; the driving portion of the lever mechanism is a bulge disposed at one end of the rod body, the bulge of the driving portion of the lever mechanism has smooth arc surface.

Preferably, the press direction of the ejecting button is the same as the rotating direction of the lever mechanism; or the press direction of the ejecting button is perpendicular to the rotating direction of the lever mechanism, one end of the ejecting button towards the lever mechanism disposes a slide slope which engages with the driving portion of the lever mechanism to drive the driving portion of the lever mechanism rotating towards the cigarette slot.

Preferably, the ejecting button is an integrated structure formed by the driving portion of the lever mechanism stretching towards the external of the box body.

Preferably, the first elastic element is fixedly connected between the bottom seat and the box body; the bottom seat and the first elastic element are linearly aligned with the cigarette slot; the bottom seat detachably act with the lower end of the cigarette slot.

Preferably, a width of the bottom seat is corresponding to a width of the cigarette slot; one end of the bottom seat towards the cigarette slot has an inner recess body matching with the outer contour of the electronic cigarette to coordinate with the cigarette slot to fix the electronic cigarette; when electronic cigarette is inserted into the cigarette slot, a distal end of is the electronic cigarette is accommodated in the inner recess body and abuts to a bottom wall of the inner recess body.

Preferably, the cigarette slot is a straight slot with an upper end open and a lower end open.

Preferably, the inner recess body is a U-shape slot.

Preferably, the cigarette slot is an independent cigarette slot of which inner contour matches with the outer contour of the electronic cigarette to accommodate a single electronic cigarette.

Preferably, the first elastic element is a compression spring or an elastic sheet.

Preferably, the box body disposes a guiding structure to guide the moving direction of the ejecting mechanism.

Preferably, the latch of the lever mechanism is a protruding block formed by one end of the lever mechanism adjacent to the ejecting mechanism stretching towards the ejecting mechanism, and the protruding block latches with the upper end of the bottom seat when placing the electronic cigarette and separates from the bottom seat when taking out the electronic cigarette.

Preferably, when the lever mechanism and the ejecting mechanism are non-latching state, the latch of the lever mechanism locates at the lower end of the bottom seat.

Preferably, the latch of the lever mechanism and the opposite sides of the bottom seat of the ejecting mechanism corresponding disposes inclined plane for matched sliding with each other.

Preferably, the lever mechanism disposes an elastic restore structure which elastically fixes the lever mechanism and drives the lever mechanism reset.

Preferably, the elastic restore structure is an elastic arm formed by the driving portion of the lever mechanism stretching to abut the outer wall of the cigarette slot; or the elastic restore structure is a second elastic element cooperatively disposed with the lever mechanism.

Preferably, the second elastic element is a torsion spring sleeved on the rotation shaft with one foot elastically abutting to the lever mechanism and the other foot elastically abutting to the internal of the box body.

Preferably, the ejecting mechanism carrying one end of the electronic cigarette is inserted into the cigarette slot and moves up and down along with the in-and-out direction of the electronic cigarette, the ejecting mechanism acts coordinately with the lower end of the cigarette slot:, when the electronic cigarette being inserted into the cigarette slot for storage, the ejecting mechanism is far away from the cigarette slot and latched by the lever mechanism; when the electronic cigarette being ejected from the cigarette slot, the ejecting mechanism is released from the latching of lever mechanism and moves towards the cigarette slot to abut to the lower end of the cigarette slot.

The advantage of the present invention are: by disposing the ejecting mechanism and the lever mechanism engaging with each other at the lower end of the cigarette slot, and by using the ejecting button to control the lever mechanism on the ejecting mechanism of the latching and releasing latching, thus achieve the electronic cigarette being automatically ejected out. It is unnecessary to hand out the electronic cigarette and has a simple structure, and is convenient and healthy to use, and is easy to extract. Furthermore, the electronic cigarette of the present invention can be repeatedly inserted into the cigarette slot for storage or ejected out from the cigarette slot for using. It makes electronic cigarette storage and repeatedly use more convenient.

Embodiments of the present invention will be further described in detail in the following drawings.

DETAILED DESCRIPTION OF THE INVENTION

Figure 1:
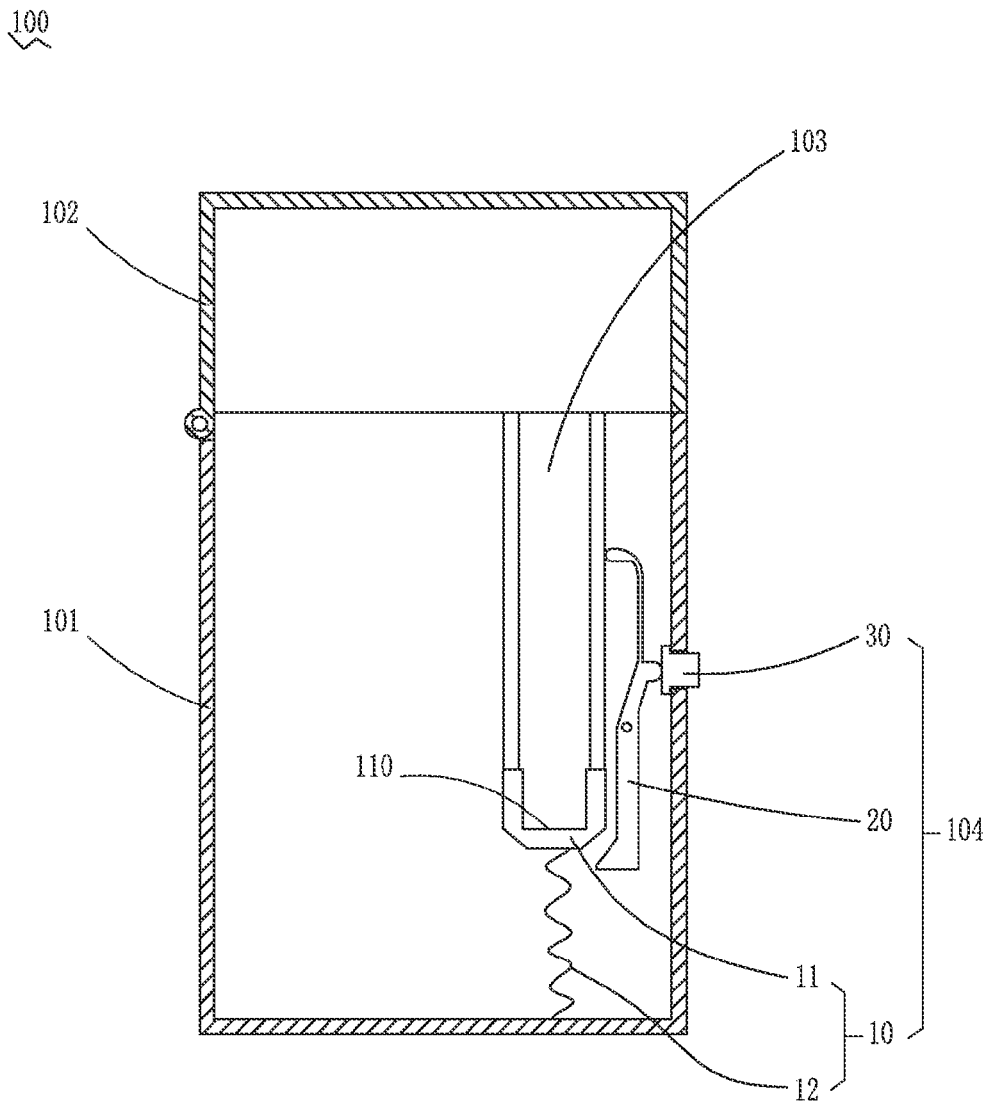
FIG. 1 is a structural schematic view of an electronic cigarette box according to a first embodiment of the present invention.

Referring to FIG. 1 to FIG. 11, an embodiment of the present invention provides an electronic cigarette box 100, including a box body 101 and a cover body 102.

The box body 101 is used for storing an electronic cigarette 200, and the box body 101 defines a cigarette slot 103 therein for accommodating the electronic cigarette 200. The cigarette slot 103 is arranged along a height direction of the box body 101, and is open respectively at an upper end and a lower end. In the embodiment, an inner contour of the cigarette slot 103 matches with an outer contour of the electronic cigarette 200 to accommodate a single electronic cigarette 200. The cover body 102 hinges on one end of the box body 101 to cover the box body 101. At the joint of the box body 101 and the cover body 102 corresponding disposes a latching mechanism (not shown) matching and engaging with each other. The latching mechanism can be set as any kind of existing structure which can make the box body 101 and the cover body 102 latched, such as protrusion and groove corresponding disposed in the opposite sides on the box body 101 and the cover body 102 or other proper positions.

Figure 5:
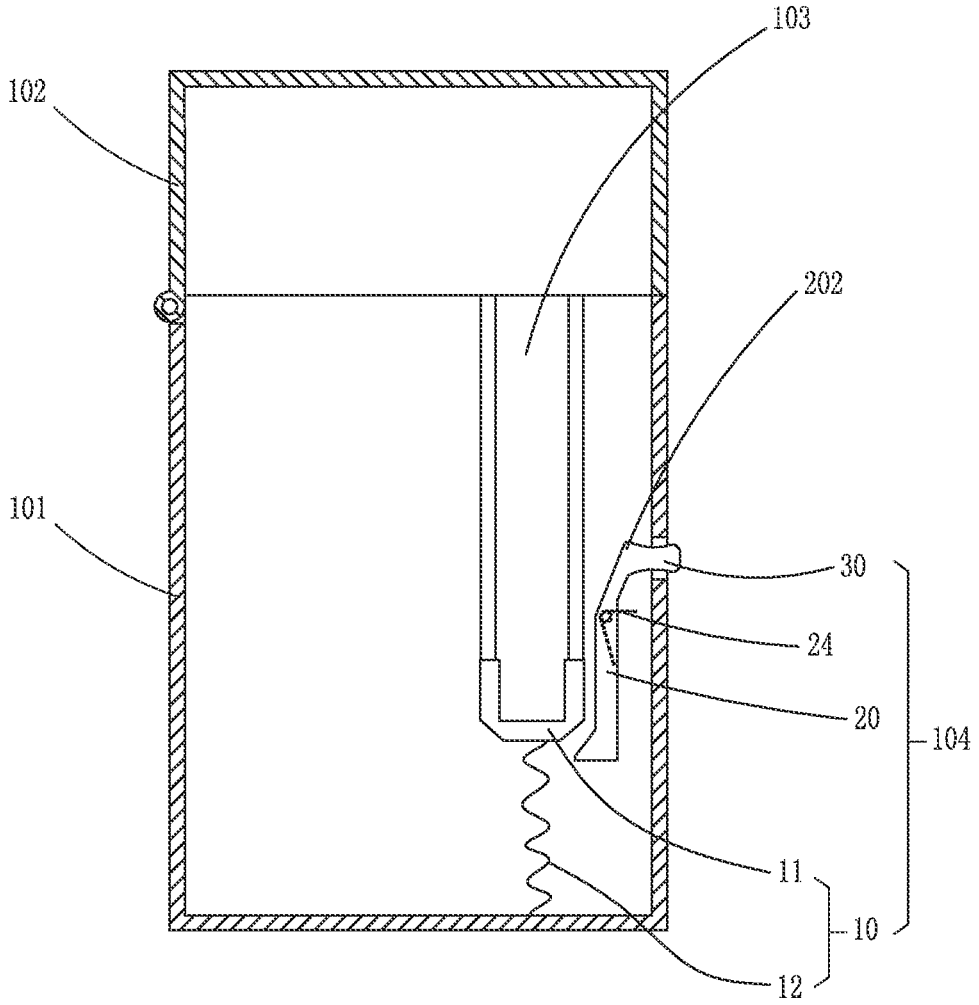
FIG. 5 is a structural schematic view of an electronic cigarette box according to a second embodiment of the present invention.
Figure 6:
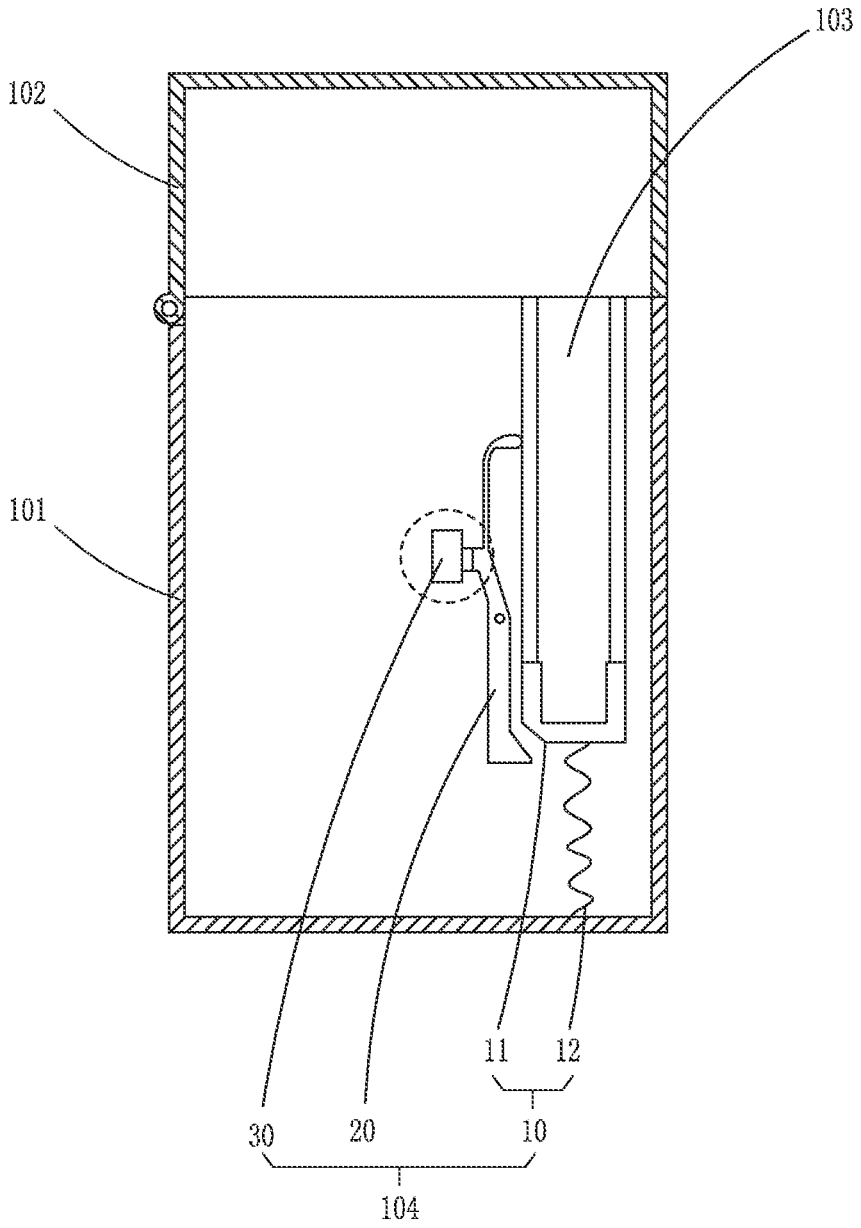
FIG. 6 is a structural schematic view of an electronic cigarette box according to a third embodiment of the present invention.

Referring to FIG. 1, FIG. 5 and FIG. 6, in the embodiment, the box body 101 disposes an ejecting device 104 to eject the electronic cigarette 200 corresponding to the cigarette slot 103. The ejecting device 104 includes an ejecting mechanism 10 and a lever mechanism 20.

Figure 2:
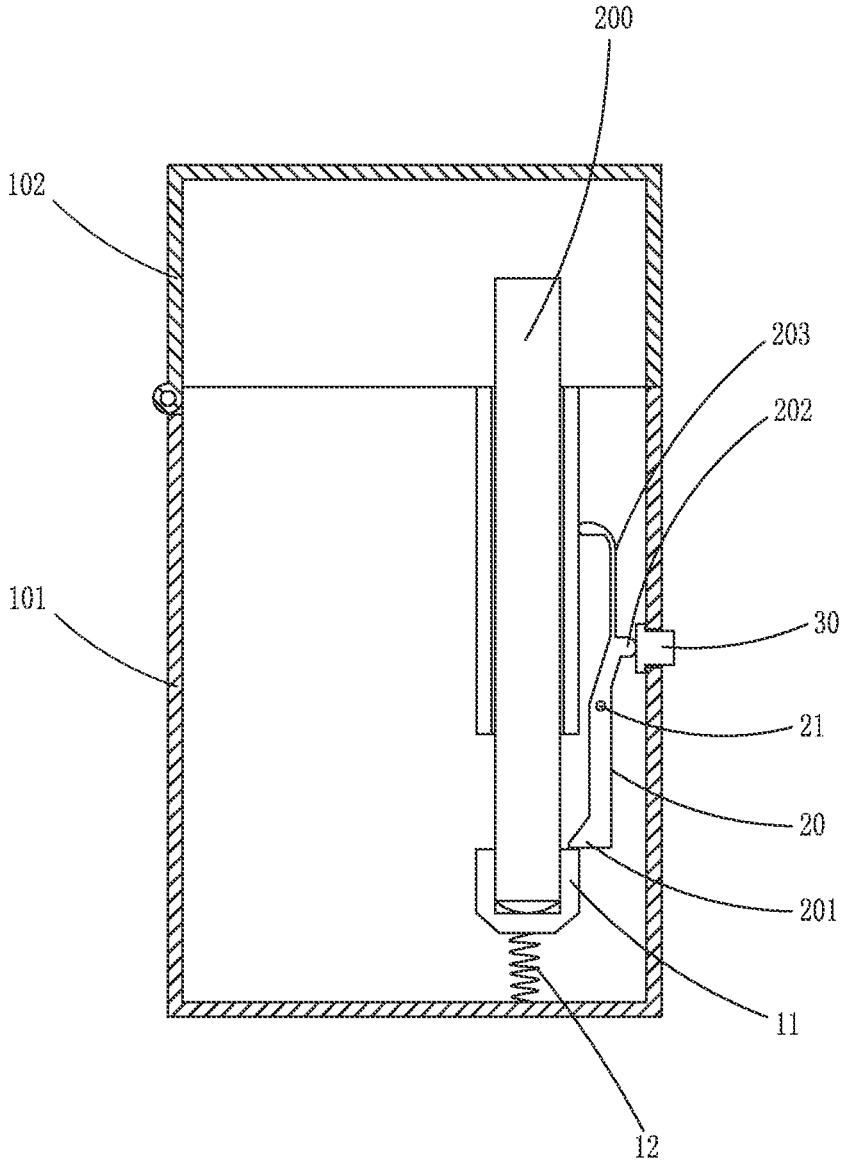
FIG. 2 is a structural schematic view of an electronic cigarette box with an electronic cigarette according to the first embodiment of the present invention.
Figure 7:
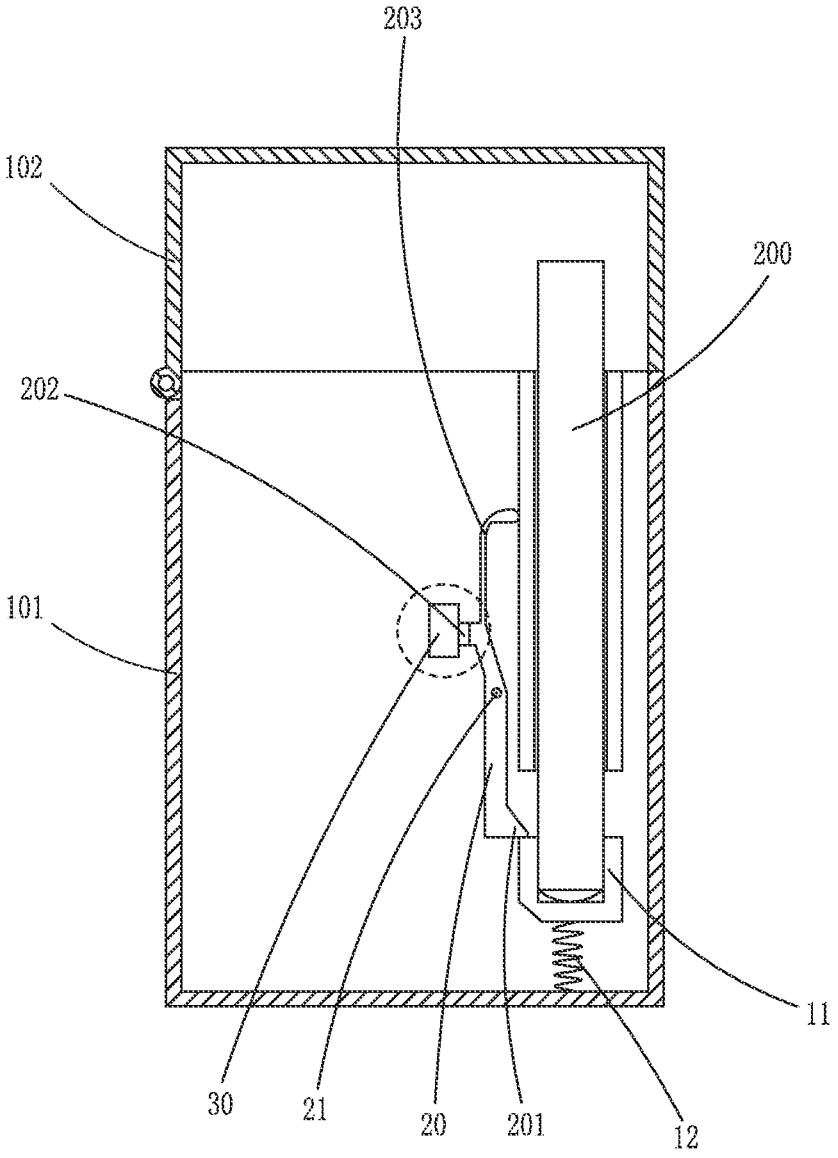
FIG. 7 is structural schematic view of an electronic cigarette box with an electronic cigarette according to a third embodiment of the present invention.

Referring to FIG. 2 and FIG. 7, the ejecting mechanism 10 is disposed at the lower end of the cigarette slot 103. When the electronic cigarette 200 being inserted, the ejecting mechanism 10 is elastically resisted between the electronic cigarette 200 and the box body 101 along an in-and-out direction of the electronic cigarette 200. In the embodiment, the ejecting mechanism 10, the cigarette slot 103 and the accommodated electronic cigarette 200 are linearly aligned along with the height direction of the box body 101. The lever mechanism 20 is disposed corresponding to the ejecting mechanism 10, and can removably latch the ejecting mechanism 10 such that when placing the electronic cigarette 200, the lever mechanism 20 latches the ejecting mechanism 10, and release the latching with the ejecting mechanism 10 when taking out the electronic cigarette 200.

The ejecting mechanism 10 includes a bottom seat 11 and a first elastic element 12 which are orderly disposed below the cigarette slot 103. Under the action of the first elastic element 12, the bottom seat 11 acts coordinately with the lower end of the cigarette slot 103 to cooperatively accommodate the electronic cigarette 200 together with the cigarette slot 103, and simultaneously make the electronic cigarette 200 inserted in or ejected out for using. Therefore, the electronic cigarette 200 can be inserted into or ejected out from the cigarette slot 103 repeatedly. In the embodiment, the cigarette slot 103, the bottom seat 11 and the first elastic element 12 are linearly aligned with each other, and linearly act with each other along with the in-and-out direction of the electronic cigarette 200 (that is an axial direction or depth direction of the cigarette slot 103). A width of the bottom seat 11 is corresponding to a width of the cigarette slot 103. One end of the bottom seat 11 towards the cigarette slot 103 has an inner recess body 110 matching with the outer contour of the electronic cigarette 200 and acting with the cigarette slot 103 to fix the electronic cigarette 200. The inner recess body 110 and the cigarette slot 103 are linearly aligned with each other to cooperatively accommodate the electronic cigarette 200. When the electronic cigarette 200 is inserted into the cigarette slot 103, a distal end of the electronic cigarette 200 is accommodated in the inner recess body 110 and abuts to a bottom wall of the inner recess body 110. The first elastic element 12 is fixedly connected between the bottom seat 11 and the box body 101 to elastically fix the bottom seat 11 in the box body 101. In the embodiment, the first elastic element 12 is a compression spring.

In the embodiment, the bottom seat 11 includes a side wall 1102 and a bottom wall 1104. The side wall 1102 and the bottom wall 1104 cooperatively surround to form the inner recess body 110. After the electronic cigarette 200 being inserted into the cigarette slot 103, the distal end of the electronic cigarette 200 extends from the lower end of the cigarette slot 103 and is accommodated in the inner recess body 110 and abuts to an inner surface of the bottom wall 1104. One end of the first elastic element 12 is fixed on a lower surface of the bottom wall 1104 of the bottom seat 11, and the other end of the first elastic element 12 is fixed on a bottom wall 1010 of the box body 101. The bottom seat 11 carried by the first elastic element 12 can linearly move up and down along the in-and-out direction of the electronic cigarette 200, that is the axial direction of the cigarette slot 103, and coordinate acts with the lower end of the cigarette slot 103. That is, by the aid of the first elastic element 12, the bottom seat 11 can move up and down along the in-and-out direction of the electronic cigarette 200 and coordinately acts with the lower end of the cigarette slot 103. The side wall 1102 of the bottom seat 11 matches the diameter of the cigarette slot 103. When the electronic cigarette 200 is ejected out of the box body 101 from the cigarette slot 103, under the elastic force of the first elastic element 12, the bottom seat 11 moves upward to the upper surface of the side wall 1102 and abuts to the lower end of the cigarette slot 103 to be locked. When the electronic cigarette 200 is inserted into the cigarette slot 103, the distal end of the electronic cigarette 200 extends into the inner recess body 110 of the bottom seat 11 to push the bottom wall 1104 moves downwards. Then the bottom seat 11 is spaced a distance from the lower end of the cigarette slot 103 until the electronic cigarette 200 being accommodated in the box body 10, and an insert end of the electronic cigarette 200 is contained in the inner recess body 110 of the bottom seat 11.

In the embodiment, the bottom seat 11 is a U-shape slot with an upper end open.

It is understood that the first elastic element 12 can also be an elastic sheet or any other elastic structure which exerts elastic force along the in-and-out direction of the electronic cigarette 200.

In specific disposition, in order to avoid the deformation of the first elastic element 12 caused by the long-term process of compression and rebound of the ejecting mechanism 10 and leads to misaligning between the bottom seat 11 and the cigarette slot 103, thus affect the accommodation of the electronic cigarette 200, the box body 101 further disposes a guiding mechanism (not shown) to guide the movement direction of the ejecting mechanism 10. In the embodiment, the guiding mechanism can be disposed as any existing guiding mechanism with guiding function, such as a guide pillar arranged around the periphery of the bottom seat 11, or a vertical guide rail fixed on the side wall 1102 of the bottom seat 11. The guiding mechanism also can be disposed as a slide slot to guide the movement of the first elastic element 12.

Referring to FIG. 1 to FIG. 9, in the embodiment, the lever mechanism 20 is pivotally connected with a rotating shaft 21 and fixed in the box body 101 by the rotating shaft 21. The lever mechanism 20 is a rod body, and has a latch 201 for latching the ejecting mechanism 10 at one end thereof when accommodating the electronic cigarette 200, and a driving portion 202 at the other end thereof. The power portion 202 rotates toward the cigarette slot 103 under the action of external force to drive the latch 201 to release the latch on the ejecting mechanism 10, then makes the electronic cigarette 200 ejected out. The latch 201 and the driving portion 202 locate on the opposite sides of the rotation shaft 21 of the lever mechanism 20. The driving portion 202 is a bulge. As in an embodiment, the driving portion 202 is a bulge with smooth arc surface. In the embodiment, the rod body of the lever mechanism 20 is disposed along the length direction of the cigarette slot 103 and locates inside the box body 101 between the side wall (not shown) of the box body 101 and the cigarette slot 103. The latch 201 releasably acts with the bottom seat 11 of the ejecting mechanism 10.

Referring to FIG. 2, FIG. 3, FIG. 7 and FIG. 8, in the embodiment, the latch 201 is a protruding block formed by one end of the lever mechanism 20 adjacent to the ejecting mechanism 10 stretching towards the ejecting mechanism 10. The protruding block resists the upper end of the bottom seat 11 when placing the electronic cigarette 200 and separates from the bottom seat 11 when taking out the electronic cigarette 200. When the lever mechanism 20 and the ejecting mechanism 10 are non-latching state, the latch 201 of the lever mechanism 20 locates at the lower end of the bottom seat 11 and separates from the bottom seat 11. In order to make the lever mechanism 20 and the bottom seat 11 more easily to achieve latching and separating, the latch 201 of the lever mechanism 20 and the opposite sides of the bottom seat 11 corresponding disposes an inclined plane 2011, 111 for matched sliding with each other.

Referring to FIG. 1 to FIG. 9, the ejecting device 104 also includes an ejecting button 30. One end of the ejecting button 30 abuts to the driving portion 202 of the lever mechanism 20, and the other end of the ejecting button 30 stretches out of the box body 101. The lever mechanism 20 and the ejecting button 30 are in transmission-connected to separate the latch 201 from the ejecting mechanism 10 under the control of the ejecting button 30, and then releases the latch of the ejecting mechanism 10.

As an embodiment, the ejecting button 30 and the lever mechanism 20 are disposed as separate structure. Referring to FIG. 1 to FIG. 4, in the specific embodiment, the ejecting button 30 is preferably disposed on one side wall of the box body 101 opposite to the rotation direction of the lever mechanism 20, and the press direction of the ejecting button 30 is the same to the rotating direction of the lever mechanism 20. Or in other embodiments, referring to FIG. 6 to FIG. 11, the ejecting button 30 is disposed on one side wall of the box body 101 which is perpendicular to the rotation direction of the lever mechanism 20, and the press direction of the ejecting button 30 is perpendicular to the rotation direction of the lever mechanism 20.

Referring to FIG. 5, as an embodiment, the press direction of the ejecting button 30 is disposed as the same to the rotation direction of the lever mechanism 20. The ejecting button 30 can be an integrated structure formed by the driving portion 202 of the lever mechanism 20 stretching along the rotation direction of the lever mechanism 20 towards the outside of the box body 101.

Figure 10:
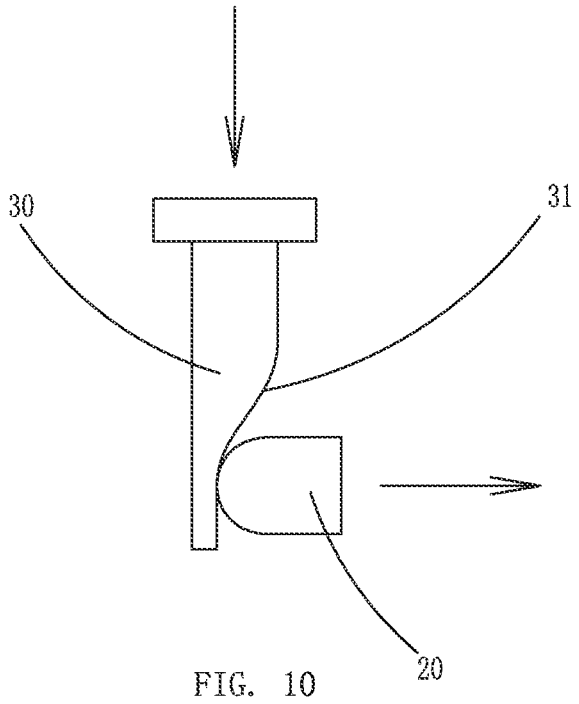
FIG. 10 is a structural schematic view of an electronic cigarette box with an ejecting button and a lever mechanism being initial state according to the third embodiment of the present invention.
Figure 11:
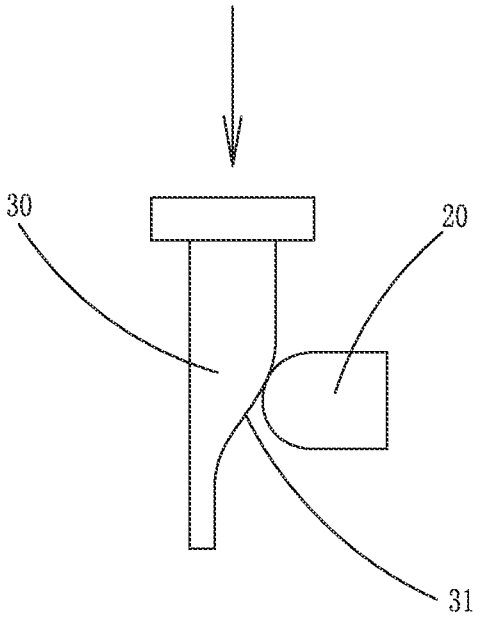
FIG. 11 is a structural schematic view of an electronic cigarette box with the ejecting button and the lever mechanism being stressed state according to the third embodiment of the present invention.

Referring to FIG. 10 and FIG. 11, when the press direction of the ejecting button 30 is disposed perpendicular to the rotation direction of the lever mechanism 20, one end of the ejecting button 30 towards the lever mechanism 20 disposes a slide slope 31 which engages and slides with the driving portion 202 of the lever mechanism 20 to drive the driving portion 202 of the lever mechanism 20 rotating towards the cigarette slot 103. When taking out the electronic cigarette 200, pressing the ejecting button 30, then the ejecting button 30 moves towards the internal of the box body 101 and the driving portion 202 of the lever mechanism 20 slides toward the cigarette slot 103 along the glide slope 31 of the ejecting button 30, therefore driving the latch 201 of the lever mechanism 20 separates from the bottom seat 11 and release the bottom seat 11. At the same time, the bottom seat 11 carrying the lower end of the electronic cigarette 200 moves upward under the elastic force of the first elastic element 12 to eject the electronic cigarette 200 out until the bottom seat 11 resists the lower end of the cigarette slot 103. When inserting the electronic cigarette 200, the electronic cigarette 200 is forced to drive the bottom seat 11 moving downward to compress the first elastic element 12 until the electronic cigarette 200 is completely placed in, and the latch 201 of the lever mechanism 20 latches with and lock the upper end of the bottom seat 11. Therefore, when need to use, pressing the ejecting button 30 to start the ejecting mechanism 10 can eject the electronic cigarette 200. When storing, the electronic cigarette 200 is pressed into the cigarette slot 103 by force until the lever mechanism 20 locks the ejecting mechanism 10. The electronic cigarette 200 has certain hardness and strength. Therefore, the electronic cigarette 200 can be ejected out or placed in repeatedly by pressing the ejecting button 30 and inserting downward, which make it easy to use.

In the embodiment, in order to make the latch 201 of the lever mechanism 20 stably latch the ejecting mechanism 10, the lever mechanism 20 disposes an elastic restore structure being used to elastically fix the lever mechanism 20 and drive the lever mechanism 20 to reset.

Referring to FIG. 1 to FIG. 4, as an embodiment, the lever mechanism 20 is made of plastic materials having certain elastic deformation ability. The elastic restore structure is an elastic arm 203 formed by the driving portion 202 of the lever mechanism 20 stretching to abut to the side wall of the cigarette slot 103. Specifically, when the driving portion 202 rotating towards the cigarette slot 103 by external force, the elastic arm 203 is forced to deform, and at the same time the latch 201 rotates towards the direction away from the bottom seat 11. When the external force on the driving portion 202 is released, the elastic arm 203 restores the original shape and drives the driving portion 202 and the latch 201 resetting.

As another embodiment, the elastic restore structure can also be a second elastic element matching disposed with the lever mechanism 20. Referring to FIG. 5, in the specification, the second elastic element disposed as a torsion spring 24 sleeved on the rotating shaft 21 with one foot abuts to the lever mechanism 20 and the other foot elastic abuts to the internal of the box body 101.

The above-mentioned application of the elastic restore structure also makes the latch 201 of the lever mechanism 20 move toward the ejecting mechanism 10, specifically move toward the bottom seat 11. Then when the electronic cigarette 200 is inserted into the cigarette slot 103 of the cigarette box 100 for storage, the electronic cigarette 200 is forced downward to open the compression spring 12 of the bottom seat 11 until the electronic cigarette 200 is inserted fully. At this time, the latch 201 of the lever mechanism 20 abuts to the upper end surface of the bottom seat 11 because of equilibrium principle, and the electronic cigarette 200 is stored in the electronic cigarette box.

Figure 3:
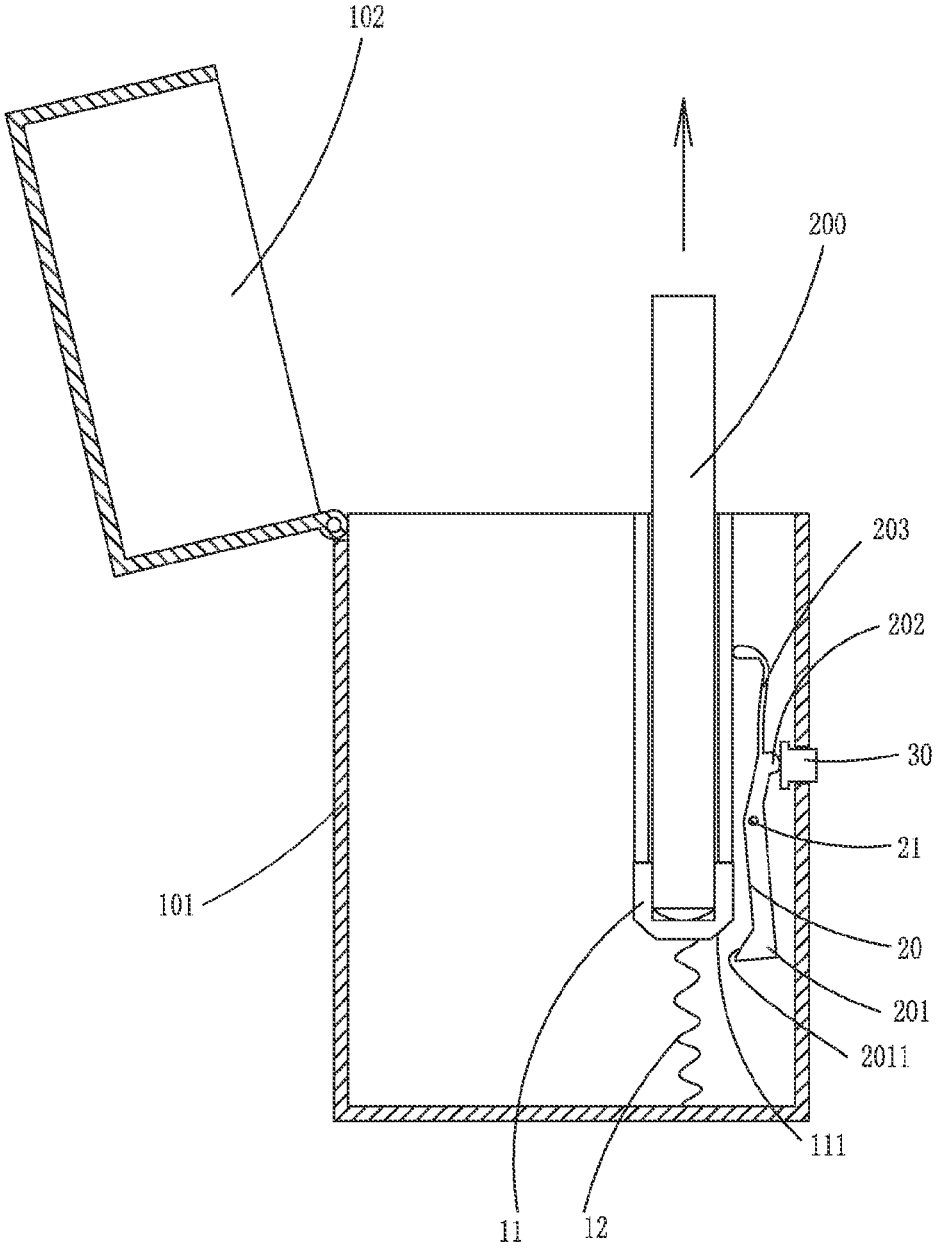
FIG. 3 is a structural schematic view of an electronic cigarette box with the electronic cigarette being elastically taken out according to the first embodiment of the present invention.
Figure 8:
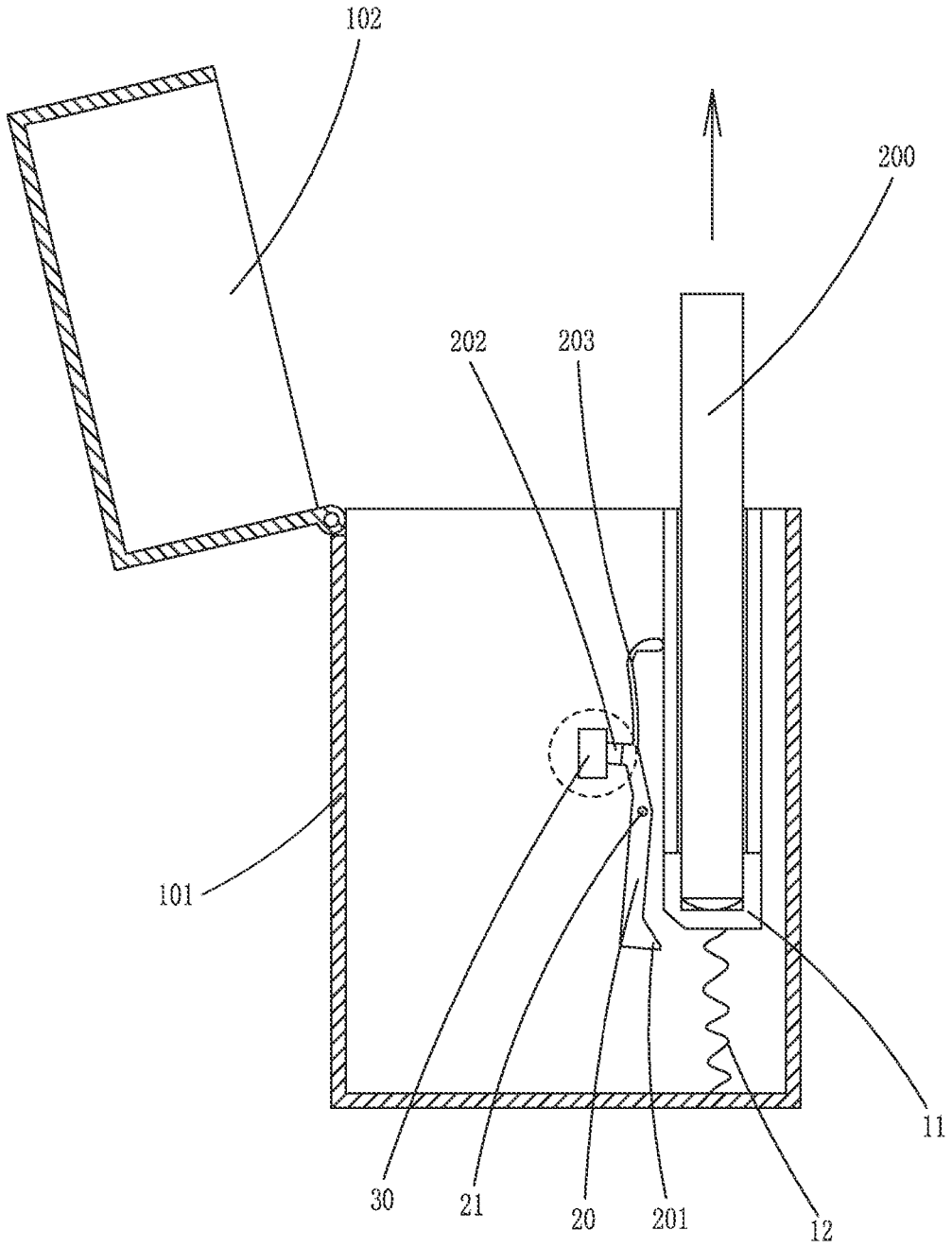
FIG. 8 is a structural schematic view of an electronic cigarette box with the electronic cigarette being elastically taken out according to the third embodiment of the present invention.

Referring to FIG. 2 and FIG. 7, when the electronic cigarette box 100 accommodates the electronic cigarette 200 therein, the latch 201 of the lever mechanism 20 abuts to the upper end of the bottom seat 11, then exerts downward force on the first elastic element 12. At this time, the first elastic element 12 is compressed state. Referring to FIG. 3 and FIG. 8, when need to smoke, press the ejecting button 30, then the ejecting button 30 drives the driving portion 202 of the lever mechanism 20 moving towards the cigarette slot 103, and leads the latch 201 of the lever mechanism 20 separating from the bottom seat 11 by the action of the rotation shaft 21, then remove the downward force on the first elastic element 12. The first elastic element 12 can rebound by its own elastic property with no downward force exerted on the first elastic element 12, until the bottom seat 11 abuts to the bottom of the cigarette slot 103. At this time, the electronic cigarette 200 is ejected out and the electronic cigarette 200 can be taken by mouth directly.

Figure 4:
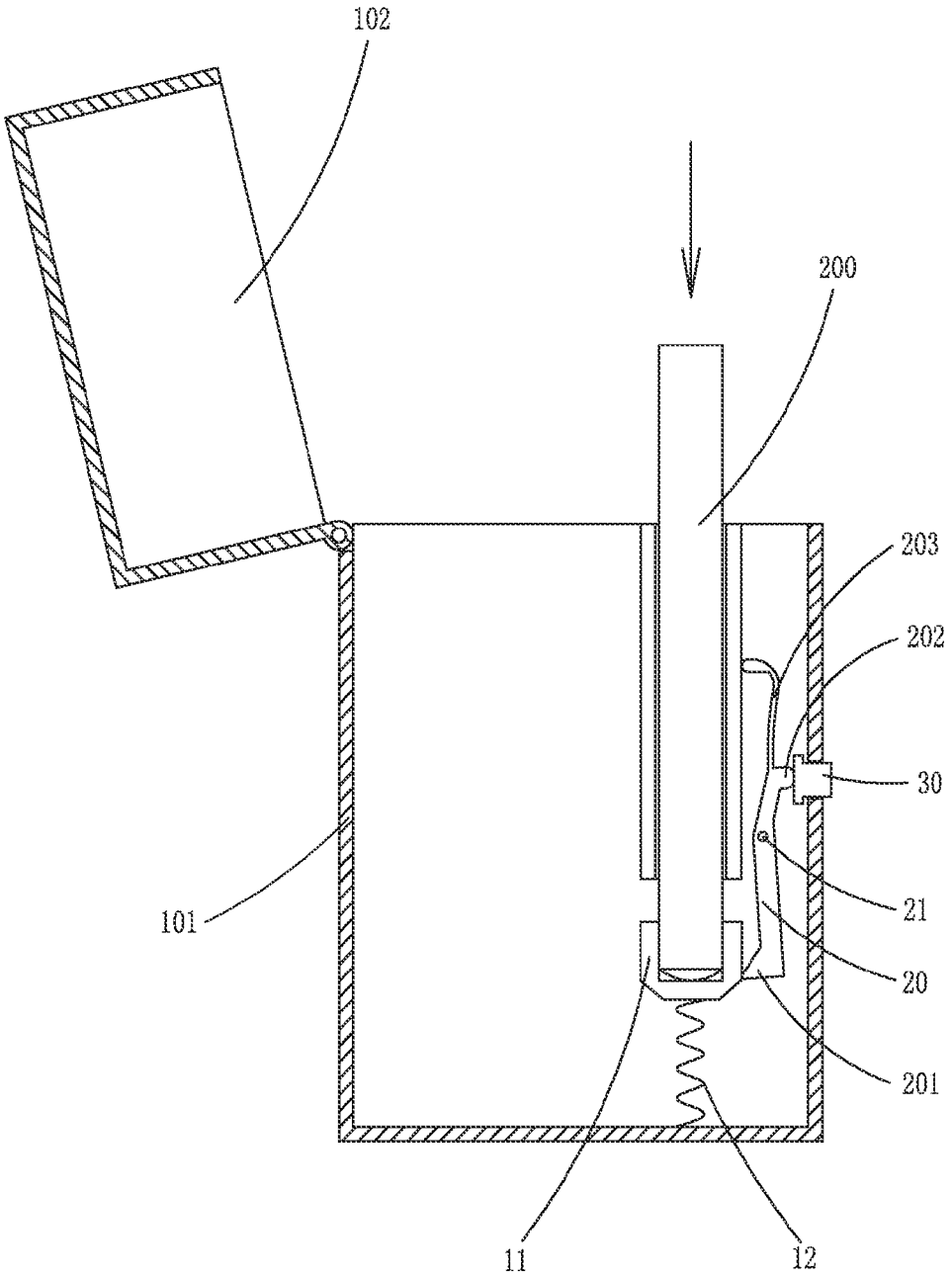
FIG. 4 is a structural schematic view of an electronic cigarette box with the electronic cigarette being inserted in according to the first embodiment of the present invention.
Figure 9:
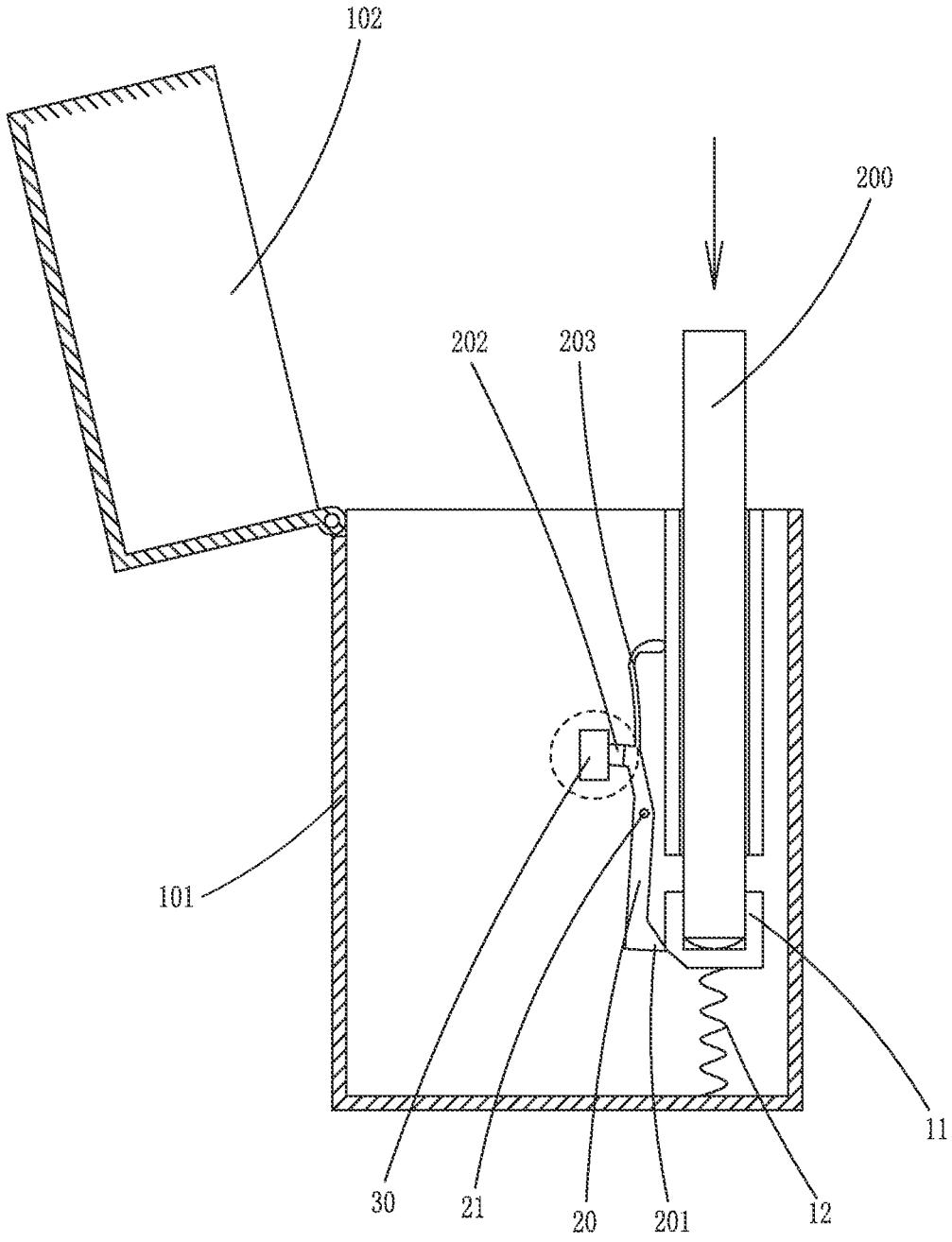
FIG. 9 is a structural schematic view of an electronic cigarette box with the electronic cigarette being inserted in according to the third embodiment of the present invention.

Referring to FIG. 4 and FIG. 9, when need to put the electronic cigarette 200 back to the electronic cigarette box 100, the electronic cigarette 200 is inserted into the cigarette slot 103. During the inserting process of the electronic cigarette 200, the electronic cigarette 200 abuts to the bottom seat 11 and continues to apply downward force on the bottom seat 11, to make the first elastic element 12 being compressed. At the same time, the latch 201 of the lever mechanism 20 slides along the outer wall of the bottom seat 11 until the bottom seat 11 goes down to the lower end of the latch 201 of the lever mechanism 20. The lever mechanism 20 resets by the force of the elastic restore structure. At this time the latch 201 of the lever mechanism 20 abuts to the upper end of the bottom seat 11, thus complete the placement of the electronic cigarette 200.

The electronic cigarette box body 101 can be further disposed a charging mechanism for charging a battery of the electronic cigarette box 100 or the electronic cigarette 200.

It is understood that the electronic cigarette boxes 100 specified in the embodiments of the present invention do not only include the embodiments shown in the FIGS. 1 to 11, therein various technical features from embodiments may be combined to form new embodiments.

Embodiments of the present invention is shown and described in the above-mentioned. Various improvement and modifications can be made to the embodiments by those skilled in the art without departing from the true spirit and scope of the disclosure. The scope of the present invention is defined by the appended claims and equivalents thereof.

What is claimed is:

1. An electronic cigarette box comprising:

a box body, the box body defining a cigarette slot for accommodating an electronic cigarette, and an ejecting device to eject the electronic cigarette, the ejecting device including an ejecting mechanism and a lever mechanism, the ejecting device being disposed at a lower end of the cigarette slot along an in-and-out direction of the electronic cigarette;

wherein the lever mechanism and the ejecting mechanism are correspondingly and engagingly disposed in the electronic cigarette box, the electronic cigarette is capable of being inserted into the cigarette slot for storage or ejected out from the cigarette slot for use repeatedly;

the ejecting mechanism includes a bottom seat and a first elastic element orderly located below the cigarette slot, the lever mechanism is a rod body fixed in the box body by a rotation shaft, one end of the lever mechanism includes a latch, and the other end of the lever mechanism includes a driving portion;

wherein the latch of the lever mechanism is a protruding block formed by one end of the lever mechanism adjacent to the ejecting mechanism stretching towards the ejecting mechanism; the protruding block latches with an upper end of the bottom seat when the electronic cigarette is inserted into the electronic cigarette slot; the protruding block separates from the bottom seat when the electronic cigarette is taken out from the electronic cigarette slot, whereby the lever mechanism and the ejecting mechanism are in a non-latching state, and a lower end of the bottom seat moves upwards above the latch of the lever mechanism; the latch of the lever mechanism and a side of the bottom seat of the ejecting mechanism corresponding form inclined planes for slidable engagement with each other.

2. The electronic cigarette box in claim 1, wherein the lever mechanism detachably latches the ejecting mechanism, when the electronic cigarette is inserted into the cigarette slot for storage, the lever mechanism latches the ejecting mechanism; and when the electronic cigarette is ejected out from the cigarette slot, the lever mechanism releases from the ejecting mechanism.

3. The electronic cigarette box in claim 1, wherein the ejecting device further includes an ejecting button, and the ejecting button controls the rotation of the lever mechanism.

4. The electronic cigarette box in claim 3, wherein the ejecting button and the lever mechanism are arranged as separable structures, one end of the ejecting button abuts to the driving portion of the lever mechanism and the other end of the ejecting button passes through a side wall of the box body.

5. The electronic cigarette box in claim 4, wherein a press direction of the ejecting button is the same as a rotating direction of the lever mechanism; or the press direction of the ejecting button is perpendicular to the rotating direction of the lever mechanism, one end of the ejecting button towards the lever mechanism forms a slide slope whereby the slide slope engages with the driving portion of the lever mechanism to drive the driving portion of the lever mechanism rotating towards the cigarette slot.

6. The electronic cigarette box in claim 3, wherein the ejecting button is an integrated structure formed by the driving portion of the lever mechanism stretching towards an external of the box body.

7. The electronic cigarette box in claim 1, wherein the driving portion of the lever mechanism is a bulge disposed at one end of the rod body, the bulge of the driving portion of the lever mechanism has a smooth and arc-shaped surface.

8. The electronic cigarette box in claim 1, wherein the first elastic element is fixedly connected between the bottom seat and the box body, the bottom seat is capable of moving up and down along the in-and-out direction of the electronic cigarette by the first elastic element, and the bottom seat is detachably engaged with the lower end of the cigarette slot.

9. The electronic cigarette box in claim 1, wherein the bottom seat and the first elastic element are linearly aligned with the cigarette slot, a width of the bottom seat is corresponding to a width of the cigarette slot.

10. The electronic cigarette box in claim 9, wherein one end of the bottom seat towards the cigarette slot has an inner recess body matching with the outer contour of the electronic cigarette to coordinate with the cigarette slot to fix the electronic cigarette, when the electronic cigarette is inserted into the cigarette slot, a distal end of the electronic cigarette is accommodated in the inner recess body and abuts to a bottom wall of the inner recess body, the cigarette slot is an independent cigarette slot in the electronic cigarette to accommodate a single electronic cigarette.

11. The electronic cigarette box in claim 10, wherein the inner recess body is a U-shape slot.

12. The electronic cigarette box in claim 1, wherein the first elastic element is a compression spring or an elastic sheet.

13. The electronic cigarette box in claim 1, wherein the box body disposes a guiding structure to guide a moving direction of the ejecting mechanism.

14. The electronic cigarette box in claim 1, wherein the ejecting mechanism carrying one end of the electronic cigarette is inserted into the cigarette slot and moves up and down along with the in-and-out direction of the electronic cigarette, the ejecting mechanism moves coordinately with the lower end of the cigarette slot; when the electronic cigarette is inserted into the cigarette slot for storage, the ejecting mechanism is far away from the cigarette slot and latched by the lever mechanism; when the electronic cigarette is ejected from the cigarette slot, the ejecting mechanism is released from the latch of the lever mechanism and moves towards the cigarette slot to abut to the lower end of the cigarette slot.

15. The electronic cigarette box in claim 1, wherein the cigarette slot is a straight slot with an upper end open and a lower end open.

16. An electronic cigarette box comprising:

a box body, the box body defining a cigarette slot for accommodating an electronic cigarette, and an ejecting device to eject the electronic cigarette, the ejecting device including an ejecting mechanism and a lever mechanism, the ejecting device being disposed at a lower end of the cigarette slot along an in-and-out direction of the electronic cigarette;

wherein the lever mechanism and the ejecting mechanism are correspondingly and engagingly disposed in the electronic cigarette box; the electronic cigarette is capable of being inserted into the cigarette slot for storage or ejected out from the cigarette slot for use repeatedly;

the ejecting mechanism includes a bottom seat and a first elastic element orderly located below the cigarette slot, the lever mechanism is a rod body fixed in the box body by a rotation shaft, one end of the lever mechanism includes a latch, and the other end of the lever mechanism includes a driving portion;

the lever mechanism comprises an elastic restore structure which elastically fixes the lever mechanism and drives the lever mechanism to reset;

wherein the elastic restore structure is an elastic arm formed by the driving portion of the lever mechanism stretching to abut the outer wall of the cigarette slot; or the elastic restore structure is a second elastic element cooperatively disposed with the lever mechanism.

17. The electronic cigarette box in claim 16, wherein the second elastic element is a torsion spring sleeved on the rotation shaft with one foot of the torsion spring elastically abutting to the lever mechanism and the other foot elastically abutting to an internal of the box body.

* * * * *